US008590814B2

(12) United States Patent
Gilpatrick et al.

(10) Patent No.: US 8,590,814 B2
(45) Date of Patent: Nov. 26, 2013

(54) NOZZLE FOR A PRESSURE WASHER

(75) Inventors: Richard J. Gilpatrick, Whitewater, WI (US); James A. Louden, Cambridge, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 805 days.

(21) Appl. No.: 12/824,984

(22) Filed: Jun. 28, 2010

(65) Prior Publication Data

US 2011/0315792 A1 Dec. 29, 2011

(51) Int. Cl.

| | |
|---|---|
| ***B05B 7/08*** | (2006.01) |
| ***B05B 7/02*** | (2006.01) |
| ***B05B 9/01*** | (2006.01) |
| ***B05B 1/14*** | (2006.01) |

(52) U.S. Cl.
USPC ..... 239/526; 239/319; 239/423; 239/424; 239/424.5; 239/532; 239/558

(58) Field of Classification Search
USPC ..... 239/302, 319, 320, 329, 333, 398, 418, 239/422, 423, 424, 424.5, 425, 428, 525, 239/526, 532, 543, 548, 549, 556, 557, 558, 239/559, 567, 589
See application file for complete search history.

(56) References Cited

U.S. PATENT DOCUMENTS

| | | | | |
|---|---|---|---|---|
| 468,589 | A * | 2/1892 | White, Lewis B. | 239/424.5 |
| 2,578,392 | A | 12/1951 | Bendersky et al. | |
| 3,620,457 | A | 11/1971 | Pearson | |
| 3,630,444 | A | 12/1971 | Nelson | |
| 3,811,622 | A | 5/1974 | Blatt | |
| 3,851,825 | A | 12/1974 | Parkison et al. | |
| 3,997,114 | A * | 12/1976 | Hewett | 239/127 |
| 4,193,550 | A | 3/1980 | Juttelstad et al. | |
| 4,341,350 | A * | 7/1982 | Wemmer | 239/312 |
| 4,795,092 | A | 1/1989 | Fuller | |
| 4,955,540 | A | 9/1990 | Fuller et al. | |
| 5,242,119 | A | 9/1993 | Jariyasunant | |
| 5,404,957 | A | 4/1995 | McCormack | |

(Continued)

FOREIGN PATENT DOCUMENTS

| | | |
|---|---|---|
| DE | 30 34769 A1 | 3/1982 |
| DE | 20 2004 015 890 | 1/2005 |
| DE | 20 2008 005 942 | 8/2009 |
| WO | WO 2006/042127 A2 | 4/2006 |

OTHER PUBLICATIONS

International Search Report and Written Opinion for Application No. PCT/US2011/041953, mail date Oct. 7, 2011, 11 pages.

*Primary Examiner* — Darren W Gorman
(74) *Attorney, Agent, or Firm* — Foley & Lardner LLP

(57) ABSTRACT

A nozzle for use with a sprayer, such as a spray gun for a pressure washer or a garden hose system, includes a body, which has an inlet for receiving a pressurized flow of water. The nozzle further includes first and second outlets, and first and second passages. The first and second outlets are formed in an end of the body. The first passage extends between the inlet and the first outlet, and the second passage extends between the inlet and the second outlet. The first and second passages are substantially straight and parallel to one another. During operation of the nozzle, the pressurized flow of water from the inlet is split, passes through the first and second passages, and exits the body from the first and second outlets.

14 Claims, 7 Drawing Sheets

(56) References Cited

U.S. PATENT DOCUMENTS

| | | | | |
|---|---|---|---|---|
| 5,467,929 | A | 11/1995 | Bosio | |
| 5,472,145 | A | 12/1995 | Shannon et al. | |
| 5,566,887 | A * | 10/1996 | Wymaster, Jr. | 239/419.3 |
| 5,779,099 | A | 7/1998 | D'Andrade | |
| 6,571,805 | B2 | 6/2003 | Hoenisch et al. | |
| 6,685,107 | B1 | 2/2004 | Salzman | |
| 7,083,120 | B2 | 8/2006 | Gilpatrick et al. | |
| 7,217,053 | B2 | 5/2007 | Alexander et al. | |
| 7,389,949 | B2 | 6/2008 | Marchand et al. | |
| 7,472,842 | B2 | 1/2009 | Gilpatrick et al. | |
| 2002/0017575 | A1 * | 2/2002 | Andrews et al. | 239/337 |
| 2003/0052199 | A1 | 3/2003 | Ikeuchi et al. | |
| 2006/0255183 | A1 | 11/2006 | Burdsall et al. | |
| 2007/0125878 | A1 | 6/2007 | Hahn et al. | |
| 2007/0221746 | A1 | 9/2007 | Heinrich et al. | |
| 2008/0061167 | A1 | 3/2008 | Gansebom | |
| 2008/0251603 | A1 | 10/2008 | Monty | |
| 2009/0050716 | A1 | 2/2009 | Binder et al. | |

* cited by examiner

NOZZLE FOR A PRESSURE WASHER

BACKGROUND

The present disclosure relates generally to the field of nozzles for boosted pressure or boosted flowrate cleaning machines, such as pressure washers and garden hose booster systems.

Household garden hoses may be used for a wide variety of tasks around a home. However at the water pressures supplied by a faucet or bibcock of a household plumbing system, the out-going streams are typically limited to a pressure of about 40 to 60 pounds per square inch (psi), flowing at a rate of about 3 to 5 gallons per minute (gpm). As such, the water pressure and flow rate may be insufficient to effectively scrub surfaces, quickly water plants, or controllably spray distant cleaning targets. To compensate for insufficient water pressure, household garden hoses may be fitted with a wide variety of fittings and nozzles to provide a stream of water with an increased exit velocity. However to increase the out-going velocity of the water stream, such nozzles may greatly reduce the out-going flow rate.

Powered pressure washers are used to clean dirt, paint, or mold from pavement, brick face, cement, or other surfaces. To achieve such results, these devices include a high-pressure water pump and generally provide a high powered water stream (e.g., approximately 1400 psi) at a modest flow rate (e.g., approximately 1.3 to 1.4 gpm). Heavy duty pressure washers may provide streams with even higher pressures (e.g., 3000 to 5000 psi) at possibly greater flow rates (e.g., approximately 3.5 gpm). The high pressure streams of heavy duty pressure washers facilitate more demanding tasks, such as resurfacing or cutting of materials.

Serving as a middle ground between unassisted garden hoses and powered pressure washers, garden hose booster pumps provide extra water pressure (e.g., between 100 to 500 psi above unassisted pressure) and increased flow rate (e.g., greater than 5 gpm) for indoor or outdoor applications, such as gardening, cleaning, or other applications. Water pressure levels produced by garden hose booster pumps are low enough that standard, conventional garden hoses may be used, but high enough to meet the requirements of various tasks, such as removing stuck-on plant debris from a vehicle, dried-on bird waste from a window, or spider webs from an eve of a high roof line, for example. As such, the added boost provided by a garden hose booster pump may produce water streams powerful enough to enhance performance of everyday household cleaning tasks that are generally outside of the capabilities of both unassisted garden hoses and powered pressure washers.

In certain applications, a long traveling distance of a cleaning machine spray beam is a useful feature, such as during second-story window cleaning from the ground or during gutter cleaning from the top of a stationary ladder. In other applications, high beam strength of a pressure washer spray beam is a useful feature, such as for washing off tree sap or bird residue. However, due to limitations of some pressure washers and unassisted or boosted garden hose systems, spraying beams may not be focused, coherent, or steady upon leaving a spray gun. Instead the spraying beams may have a high degree of turbulence and choppiness, causing beam water to scatter, weakening the beam, reducing water density of the beam, increasing the beam surface area and drag on the beam, and shortening the potential traveling distance of the beam.

SUMMARY

One embodiment of the invention relates to a nozzle for use with a sprayer, such as a spray gun for a pressure washer or a garden hose system. The nozzle includes a body that has an inlet for receiving a pressurized flow of water. The nozzle further includes first and second outlets, and first and second passages. The first and second outlets are formed in an end of the body. The first passage extends between the inlet and the first outlet, and the second passage extends between the inlet and the second outlet. The first and second passages are substantially straight and parallel to one another. During operation of the nozzle, the pressurized flow of water from the inlet is split, passes through the first and second passages, and exits the body from the first and second outlets.

Another embodiment of the invention relates to nozzle for use with a sprayer, where the nozzle includes a body having a first inlet for receiving a pressurized flow of water and a second inlet for receiving a flow of chemicals. The nozzle further includes first, second, and third outlets formed in an end of the body. A first passage extends between the first inlet and the first outlet, a second passage extends between the first inlet and the second outlet, and a third passage extends between the second inlet and the third outlet. During operation of the nozzle, the pressurized flow of water from the first inlet is split, passes through the first and second passages, and exits the body from the first and second outlets. Also the second inlet, the third passage, and the third outlet are configured to allow the flow of chemicals to exit the body during operation of the nozzle, contemporaneously with the flow of water from the first and second outlets.

Yet another embodiment of the invention relates to a spray gun, which includes a handle, a port, and a nozzle body. The handle has a trigger for selectively allowing a pressurized flow of water to pass through at least a portion of the spray gun. The port is for receiving a reservoir of chemicals to be selectively added to the pressurized flow of water. The nozzle body is connected to the spray gun, and includes a first inlet for receiving the pressurized flow of water and a second inlet for receiving a flow of chemicals from the reservoir of chemicals. The nozzle body further includes first, second, and third outlets formed in an end of the nozzle body. A first passage extends between the first inlet and the first outlet, a second passage extends between the first inlet and the second outlet, and a third passage extends between the second inlet and the third outlet. During operation of the spray gun, the pressurized flow of water from the first inlet is split, passes through the first and second passages, and exits the nozzle body from the first and second outlets. Also the second inlet, the third passage, and the third outlet are configured to allow the flow of chemicals to exit the nozzle body during operation of the spray gun, contemporaneously with the flow of water from the first and second outlets.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
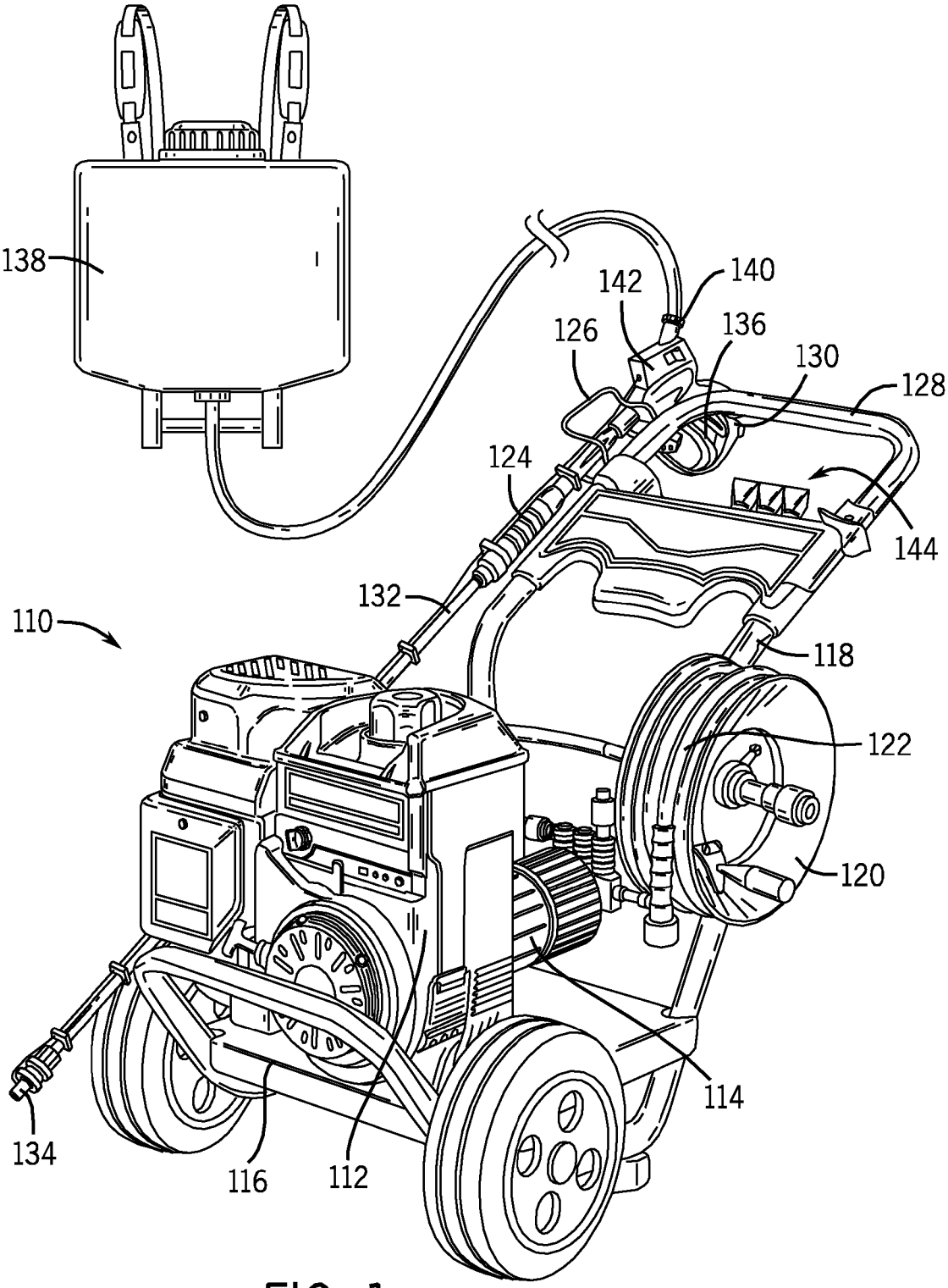
FIG. 1 is a perspective view of a pressure washer system according to an exemplary embodiment of the invention.

Referring to FIG. 1, a pressure washer system 110 includes an internal combustion engine 112 coupled to a high-pressure pump 114, such as a radial or axial cam piston pump capable of 2000-4000 psi output. The engine 112 and pump 114 are mounted to a base plate 116 of a portable frame 118. Also coupled to the frame 118 is a hose reel 120 with a high-pressure hose 122 wrapped on the hose reel 120. A sprayer in the form of a spray gun 124 is resting in a holster 126 projecting from the frame 118, near a handle 128 of the frame 118. The spray gun 124 includes a handle 130 and a shaft 132 (e.g., wand), where a nozzle 134 (e.g., soaper nozzle) is coupled to an end of the shaft 132. An assortment of alternate nozzle bodies 144 is positioned on the frame 118. Additionally, a reservoir 138 of chemicals (e.g. soap) is coupled to a port 140 on a pump 142 that is coupled to the spray gun 124. Some of the nozzle bodies 144 may include inlets for receiving both chemicals and water.

A trigger 136 on the handle 130 is used to activate or deactivate the spray gun 124. During operation of the pressure washer system 110, the engine 112 drives the pump 114, which further pressurizes a flow of water supplied by a garden hose (not shown). From the pump 114, the pressurized flow of water travels through the high-pressure hose 122 to the spray gun 124. According to the embodiment of FIG. 1, the pressurized flow of water then travels through the shaft 132 of the spray gun 124 and out of the nozzle 134. Chemicals may be injected into the pressurized flow of water as the water passes through or from the nozzle 134.

Figure 2:
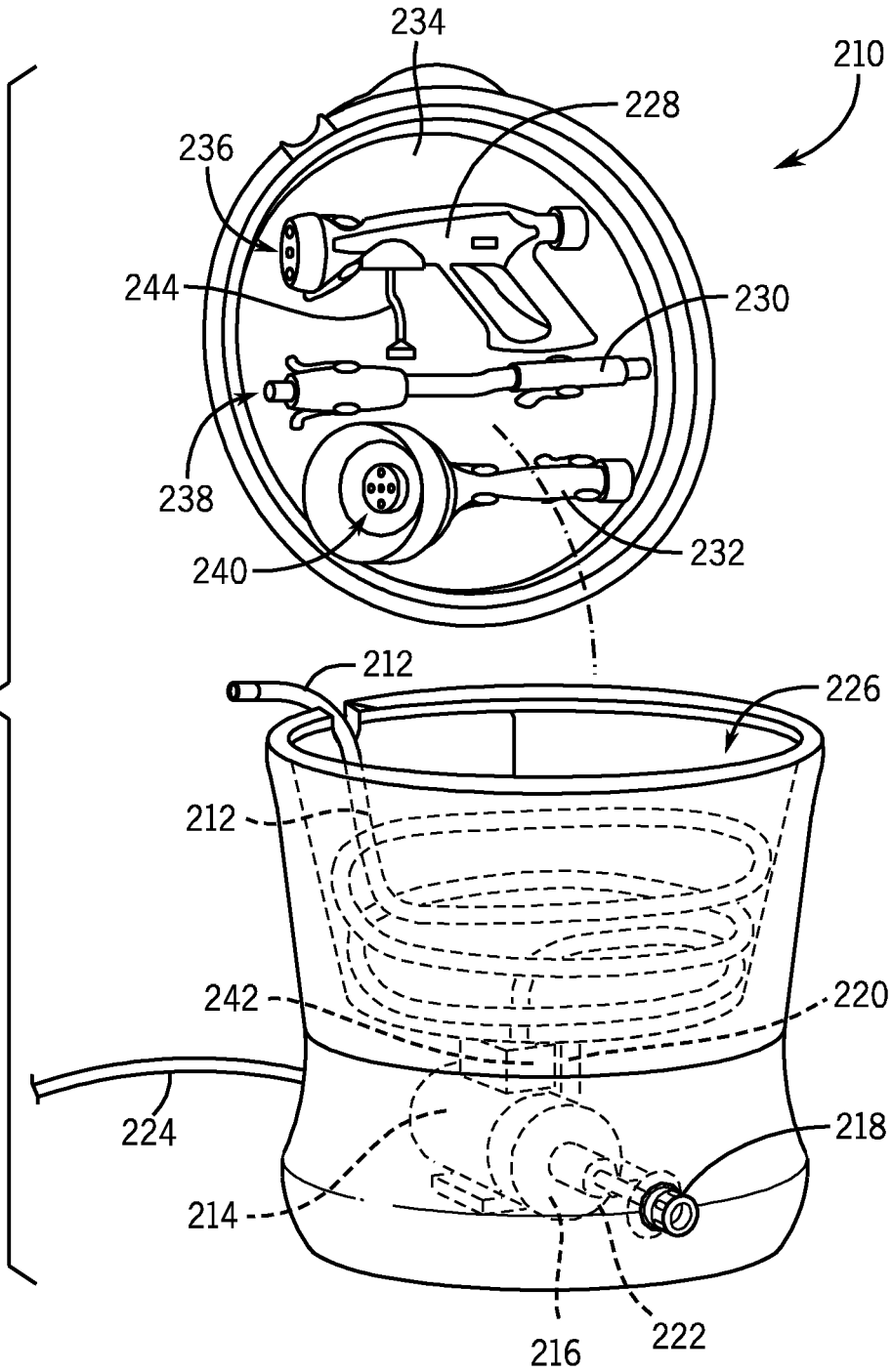
FIG. 2 is a perspective view of a garden hose booster system according to an exemplary embodiment of the invention.

Referring to FIG. 2, a booster system 210 for a garden hose 212 includes an electric motor 214 coupled to a centrifugal pump 216. In some embodiments, the booster system 210 both boosts the flow rate (e.g., from approximately 3-5 gpm to over 5 gpm) and pressure (e.g., from approximately 40-60 psi to approximately 100-500 psi) of pressurized water supplied from a faucet, bibcock, etc. The pressures and flow rates associated with the booster system 210 allow for use of a typical commercially-available garden hose (e.g., burst rating below 500 psi) to be coupled to both the inlet 218 and outlet 220 of the pump 216.

In some embodiments, the electric motor 214 may be controlled by way of sensors 222 positioned along the flow path, such as a flow rate sensor and/or a pressure sensor. In some such embodiments, information provided to a control system 242 (e.g., processor, electric switch, mechanical feedback system) from the flow rate sensor allows the pump 216 to be activated when a higher-flow nozzle or setting is used, and the pump 216 to be deactivated when a lower-flow nozzle or setting is used. Further information provided by the pressure sensor, such as the presence of trapped or back pressure near the outlet 220 of the pump 216, allows the pump 216 to be deactivated when an associated sprayer is not spraying.

An electric power cord 224 and a first garden hose coupling of the inlet 218 extend from the base of the booster system 210. The weight of the motor 214 positioned in the base provides stability to the booster system 210. According to an exemplary embodiment, the booster system 210 further includes a storage volume 226 above the base, and coupled to the pump 216 such that the outlet 220 of the pump 216 is accessible from within the storage volume 226, to be coupled to the garden hose 212.

An assortment of different sprayers 228, 230, 232 may be releasably fastened to a lid 234 for the storage volume 226. In some embodiments, the sprayers 228, 230, 232 include a spray gun 228, a spray wand 230, and a spraying brush 232. The spray gun 228 includes a tube 244 to be inserted into a chemical tank (see, e.g., chemical reservoir 138 as shown in FIG. 1) that may be coupled to the spray gun 228. Nozzles 236, 238, 240 of the sprayers 228, 230, 232 include multiple outlets (e.g., orifices, apertures, holes, openings, ports, etc.) that are designed to simultaneously release flows of water and/or chemicals.

Figure 3:
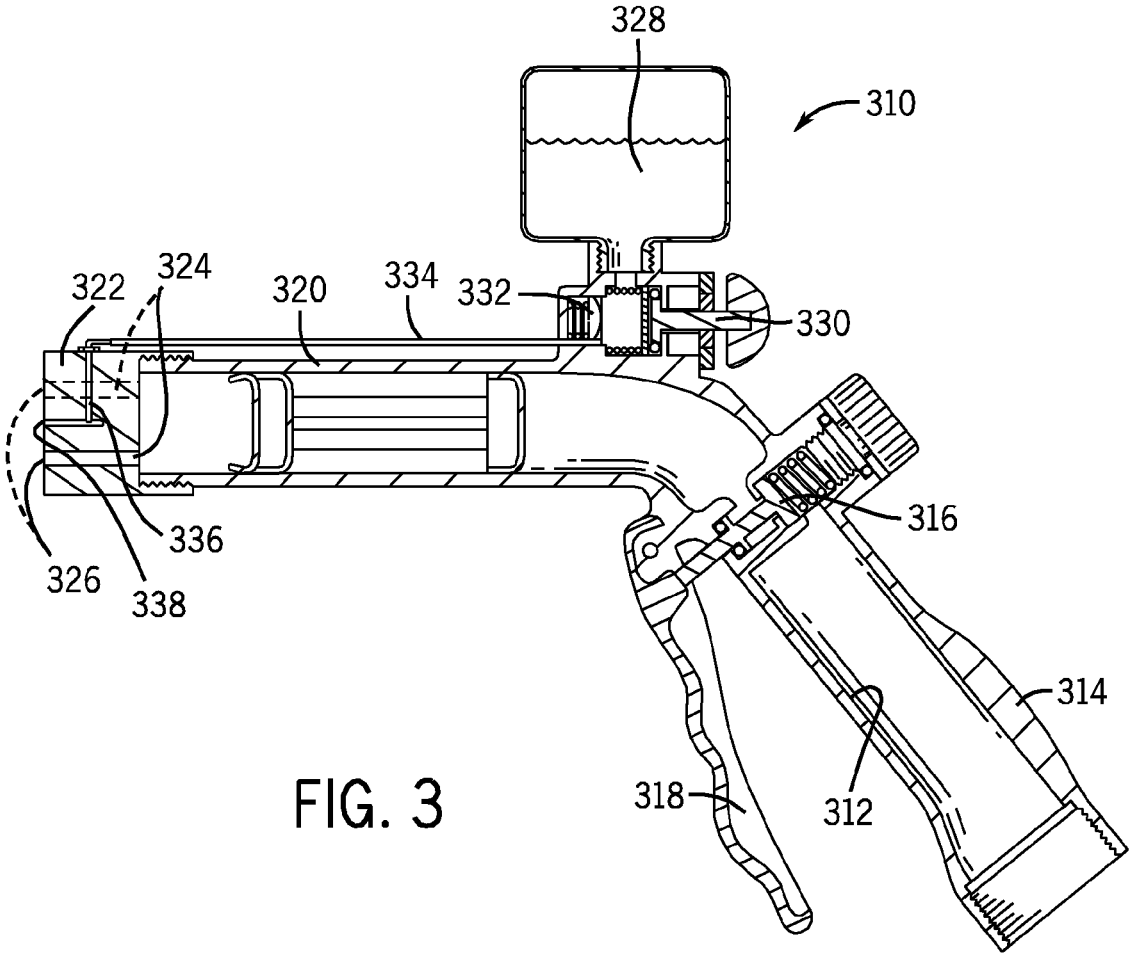
FIG. 3 is a sectional view of a sprayer according to an exemplary embodiment of the invention.

Referring to FIG. 3, a spray gun 310 is configured to be used with a booster system for a garden hose (see, e.g., booster system 210 as shown in FIG. 2), or simply with an unassisted garden hose system. A water conduit 312 extends into the spray gun 310 through a base of a handle 314 of the spray gun 310. A flow of pressurized water then selectively passes through a valve 316 controlled by a trigger 318. When the valve 316 is open, the water passes into a shaft 320 of the spray gun 310 and to a nozzle 322. The nozzle 322 includes an array of conduits 324 through which the flow of pressurized water passes. The conduits 324 split the water into smaller flow streams that simultaneously exit separate outlets 326 on an end of the nozzle 322.

Use of the array of conduits 324 is intended to reduce turbulence in the flow of pressurized water, and accordingly to increase the concentration of spray ejected from the spray gun 310. It has been observed that if the outlets 326 of the array of conduits 324 are positioned close enough together (e.g., less than a quarter inch apart) that outside of the spray gun 310 the spraying beams of water ejected through the conduit 324 converge and combine into a single beam. The single beam of water is intended to be less turbulent than it would otherwise be if the pressurized flow of water had not been split and passed through the array of conduits 324.

According to an exemplary embodiment, the spray gun 310 additionally includes a reservoir 328 of chemicals. The chemicals of the reservoir 328 may include soap, fertilizer, pesticide, dye, or other forms of chemicals to be selectively added to the pressurized flow of water. In some embodiments, two or more separate reservoirs supplying different chemicals may be coupled to a sprayer so that different chemicals and different relative amounts of chemicals may be added to the pressurized flow of water of the sprayer (e.g., reacting chemical agents). In some such embodiments, the two or more chemical reservoirs may be coupled to different corresponding chemical delivery systems for the lance or spray gun, such as a manual pump and a battery-powered pump. Although shown as attached to the top of the spray gun 310 in FIG. 3, in other embodiments, the reservoir 328 is otherwise coupled to the spray gun 310 (e.g., quick connect, threaded, snap fit, integrated into, etc.; see generally reservoir 138 as shown in FIG. 1).

According to an exemplary embodiment, the spray gun 310 further includes a pump 330 for controlling the rate at which chemicals from the reservoir 328 are added to the pressurized flow of water. The pump 330 may be a manual piston pump, a small electric pump (e.g., battery-powered), or another form of pump. One or more check valves 332 may be used to limit the direction of the flow of chemicals from the pump 330. According to an exemplary embodiment, the flow of chemicals is controllably directed from the reservoir 328 to the nozzle 322 of the spray gun 310 by way of a chemical conduit 334 (e.g., tube, small hose). The chemicals are then directed into a passage 336 in the nozzle 322 to a chemical outlet 338. In other embodiments, a venturi nozzle oriented orthogonal to the pressurized flow of water is used to facilitate injection of the chemicals into the water.

According to an exemplary embodiment, the outlets 326 of the array of conduits 324 for ejecting the flow of pressurized water are positioned near the chemical outlet 338 of the chemical passage 336 on the end of the nozzle 322. The chemicals are then added to and integrated with the combined spray beam of water outside of the spray gun 310. Further, in a preferred embodiment the chemical outlet 338 for the chemical passage 336 is positioned generally between two or more of the outlets 326 of the array of conduits 324 for the flow of pressurized water. Due at least in part to the structure of the nozzle 322, eddies and vortices in the spray beam are believed to facilitate improved mixing and integration of the chemicals and water as the spray beam passes from the spray gun 310 to a desired target. However in some embodiments, the chemicals are sprayed on top or below the water exiting the gun. In such embodiments, the chemicals may be accelerated to the exit velocity of the water streams to facilitate integration with the water streams.

Figure 4:
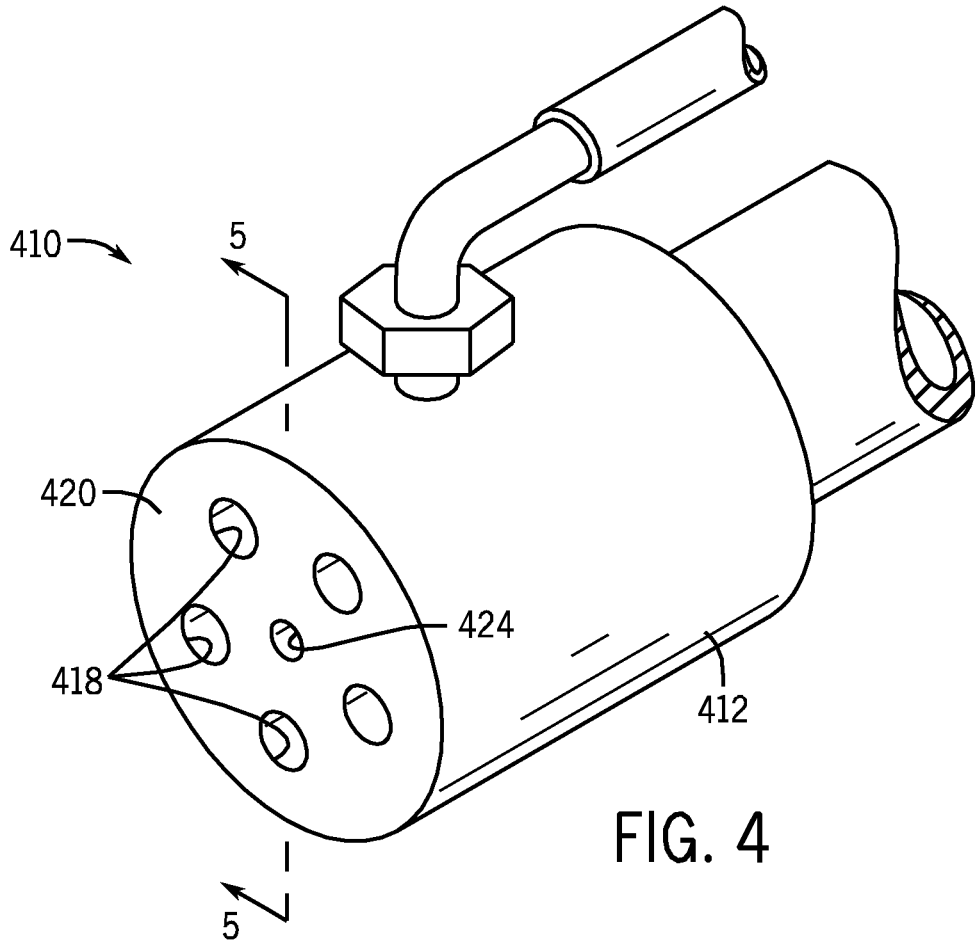
FIG. 4 is a perspective view of a nozzle according to an exemplary embodiment of the invention.
Figure 5:
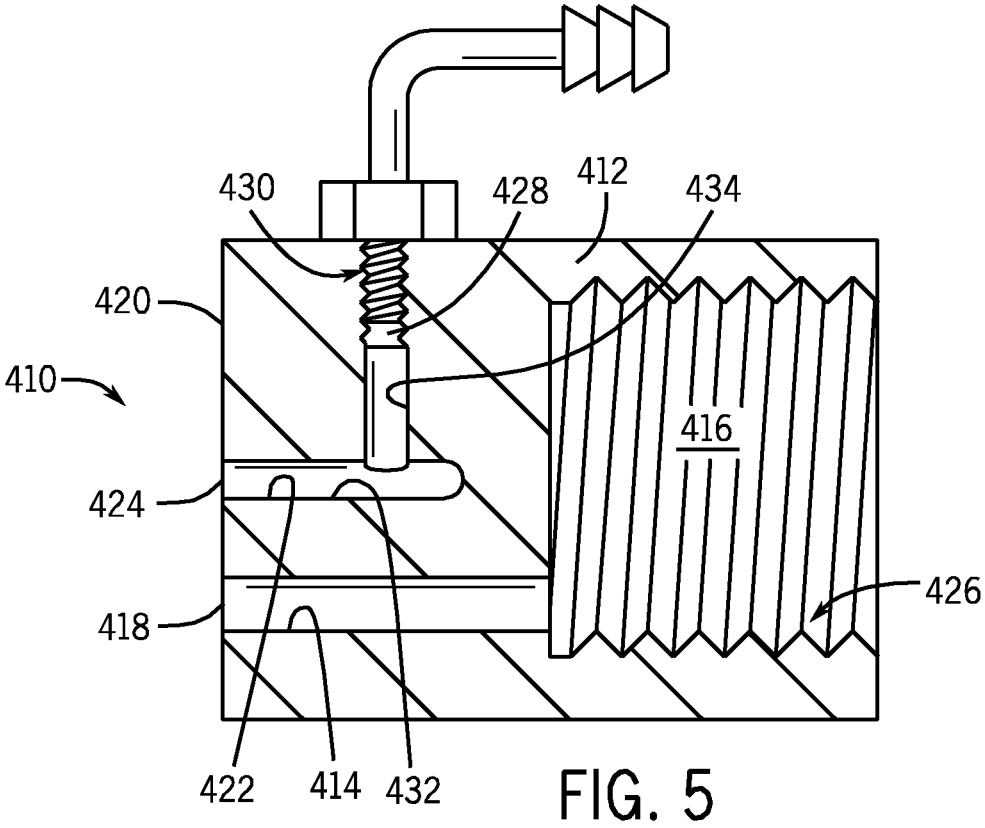
FIG. 5 is a sectional view of the nozzle of FIG. 4 taken along line 5-5 in FIG. 4.
Figure 6:
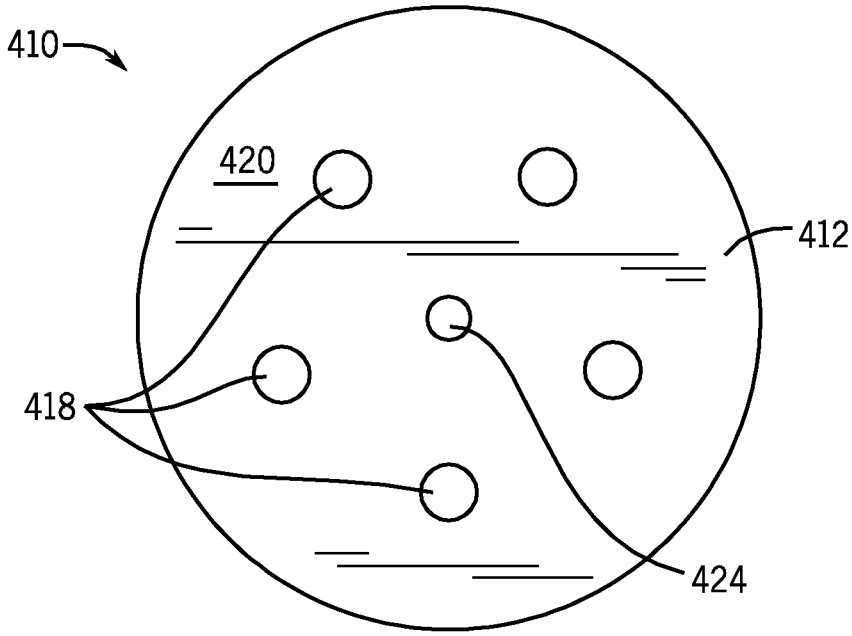
FIG. 6 is a front view of the nozzle of FIG. 4.

Referring now to FIGS. 4-6, a nozzle 410 includes a nozzle body 412. Formed in the nozzle body 412, the nozzle 410 includes an array of five water conduits 414 (FIG. 5). The water conduits 414 share a common inlet 416 (FIG. 5) but extend to separate water outlets 418 on an end 420 of the nozzle body 412. The common inlet 416 of the of the water conduits 414 is shown to include a threaded female coupling 426 (FIG. 5). However in other embodiments, an inlet includes a male coupling, a quick-connecting coupling, another form of coupling, or is permanently fastened (e.g., pinned, welded, glued, etc.) to a sprayer. Although cylindrical in shape according to an exemplary embodiment, in other contemplated embodiments the nozzle body 412 is cube-shaped, prism-shaped, egg-shaped, cone- or pyramid-shaped, includes a hexagonal cross-section, or is otherwise shaped.

According to an exemplary embodiment, the water conduits 414 extend generally straight, longitudinally through the nozzle body 412. Generally straight water conduits 414 are believed to improve nozzle efficiency relative to curved conduits because momentum, friction, and pressure losses associated with bends in the flow path are reduced.

The water conduits 414 are long enough to remove turbulence from the pressurized flow of water (e.g., generate a laminar flow, generate a less-turbulent flow). In some embodiments, the water conduits 414 are sized in cross-sectional area and length such that the Reynolds number of the water flow at each outlet 418 is less than 4000, and ideally less than 2300 for a garden hose booster system at water pressures of less than 500 psi, or for an unassisted garden hose at pressures between about 40-60 psi. In some embodiments, the water conduits 414 extend through more than a quarter of the length of the nozzle body 412 in the longitudinal direction, such as about half the length. In some embodiments, the water conduits 414 extend at least a quarter of an inch through the nozzle body 412.

According to an exemplary embodiment, the water conduits 414 are substantially parallel with each other (e.g., having an angle of intersection of less than 5-degrees when viewed on a common plane). Despite the parallel orientation, the separate water streams exiting the outlets 418 of the water conduits 414 are intended to quickly converge to a single beam. In other embodiments, the water conduits 414 are angled slightly toward the center of the end of the nozzle body 412 (e.g., by about three degrees relative to the longitudinal axis of the nozzle body 412). In at least one contemplated embodiment, conduits are each angled slightly toward the nearest next conduit in a clockwise, counter-clockwise, or helical pattern, such that rotation is added to the combined beam as the streams join outside the nozzle body 412.

Referring to FIG. 4, in some embodiments the nozzle 410 further includes at least one chemical conduit 422 (FIG. 5), separate from the water conduits 414. As with the common water inlet 416, a chemical inlet 428 includes a coupling 430, which may be any of a broad range of types of couplings (e.g., threaded, snap fit, etc.) for connecting a chemical supply to the nozzle body 412. The chemical conduit 422 extends to a chemical outlet 424 on the end 420 of the nozzle 410. According to the exemplary embodiment of FIGS. 4-6, the chemical outlet 424 is positioned in the center of the end 420 of the nozzle 410, and between the water outlets 418. Further, the water outlets 418 are each about the same distance from the chemical outlet 424 and are arranged generally symmetrically around the chemical outlet 424.

In some embodiments, the chemical conduit 422 is formed from two or more straight passages 432, 434 that intersect within the nozzle body 412. During manufacturing, the chemical conduit 422 may be drilled out of the nozzle body 412 in two cuts: downward from a side of the nozzle body 412, and inward from the end 420 of the nozzle body 412. In some such embodiments, at least one of the straight passages 432, 434 extends generally parallel to the water conduits 414. According to an exemplary embodiment, the straight passages 432, 434 are oriented generally orthogonal to each other. However, in other embodiments, the passages are not orthogonal. In another contemplated embodiment, the chemical conduit is a single straight conduit extending diagonally from the side of the nozzle body. In still other embodiments, multiple chemical conduits are included, which may extend from the same or different chemical reservoirs.

Figure 7:
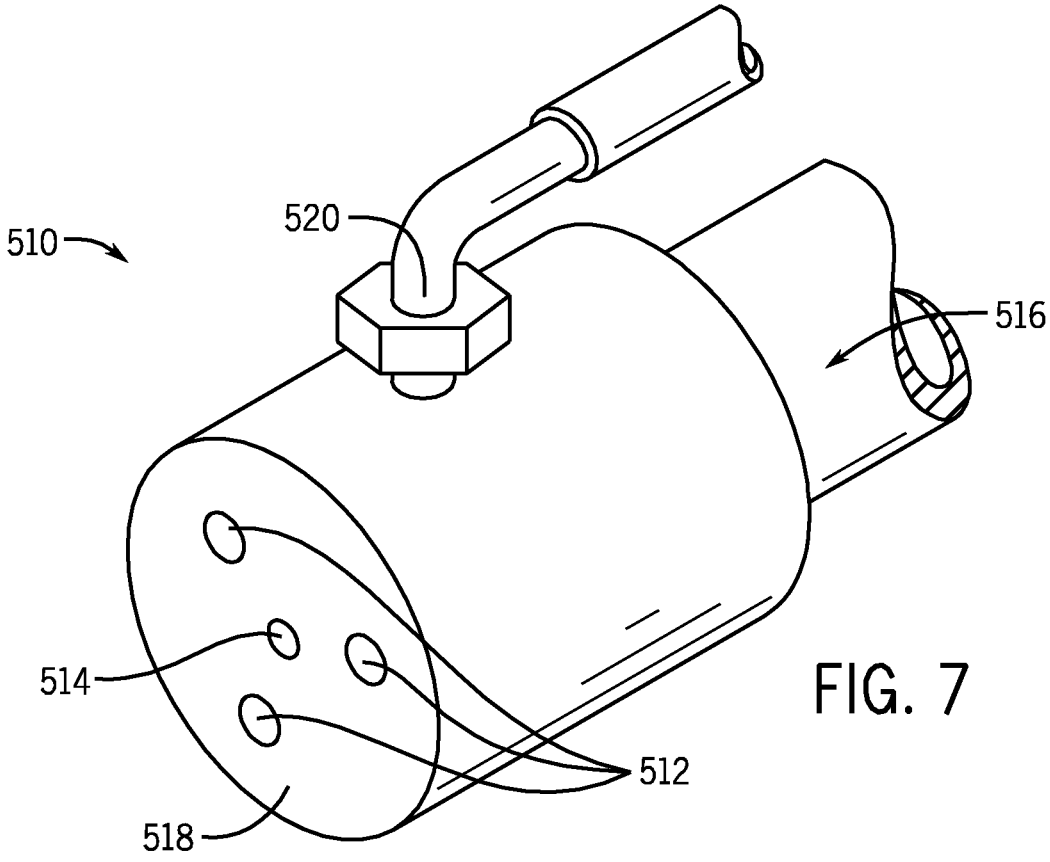
FIGS. 7-9 are perspective views of nozzles according to other exemplary embodiments of the invention.
Figure 8:
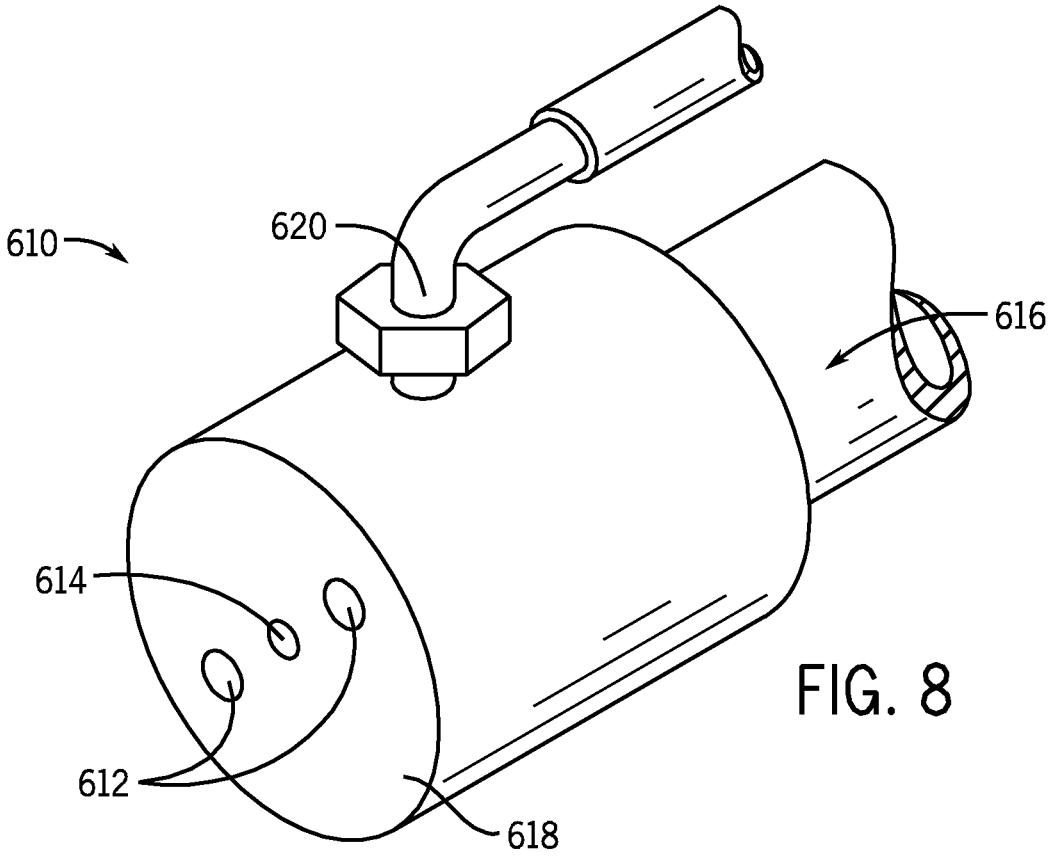

Referring to FIGS. 7-8, nozzle bodies 510, 610 include outlets 512, 612 for water and outlets 514, 614 for chemicals on ends 518, 618 of the nozzle bodies 510, 610. While the nozzle body 510 includes three outlets 512 for water surrounding the single chemical outlet 514, the nozzle body 610 includes two outlets 612 for water surrounding the single chemical outlet 614. In both exemplary embodiments, inlets 516, 616 for water are positioned on a side of the respective nozzle body 510, 610, opposite to the respective ends 518, 618 containing the outlets 512, 514, 612, 614. Furthermore, in both embodiments, inlets 520, 620 for the chemicals are provided on sides of the nozzle bodies 510, 610. Such features may be convenient for manufacturing of the nozzle bodies 510, 610 (e.g., machining straight passages). In other contemplated embodiments, inlets for chemicals are not included, or are on the same side as inlets for water.

Figure 9:
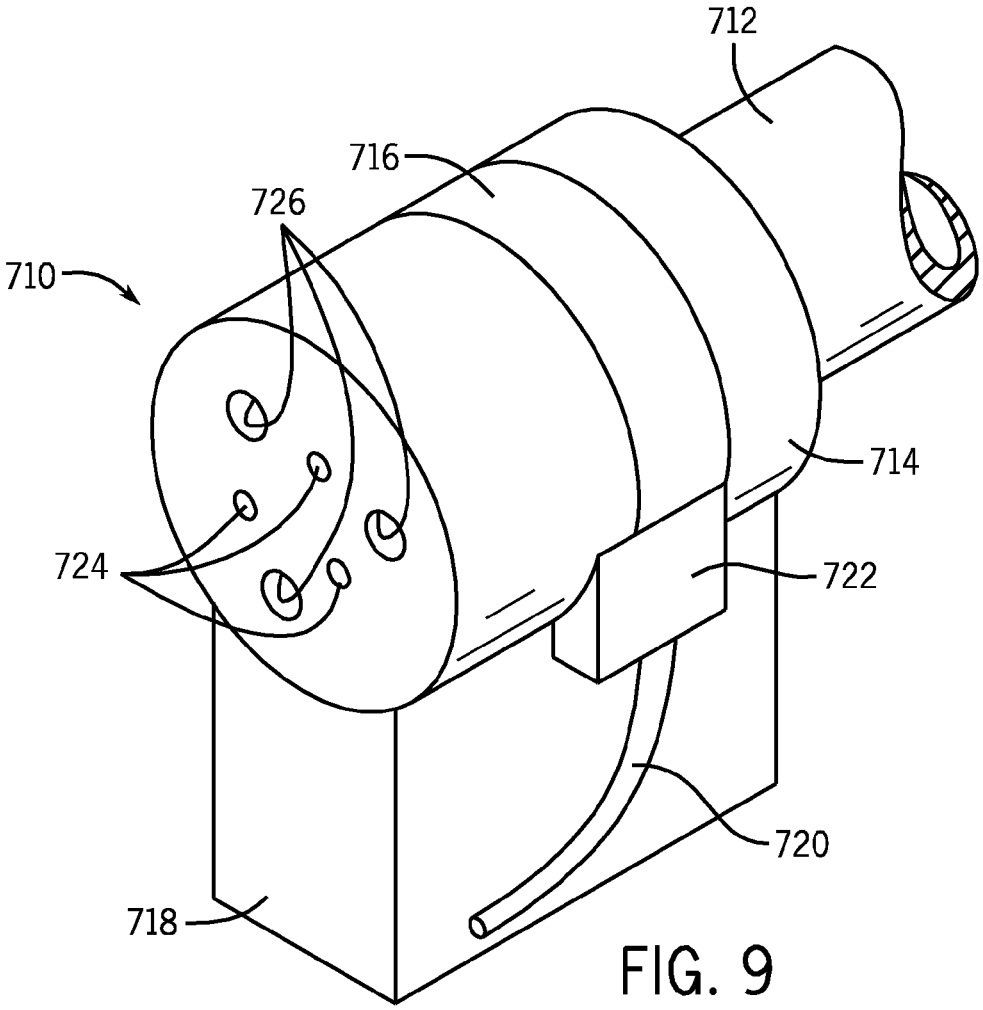

Referring to FIG. 9, a nozzle 710 is fastened to a wand 712 of a pressure washer spray gun (see, e.g., spray gun 124 as shown in FIG. 1). The nozzle 710 includes a chemical storage tank 718 fastened below a body 714 of the nozzle 710. A strap 716 or other fastener may be used to hold the storage tank 718 to the body 714 of the nozzle 710. A tube 720 allows chemicals to be pulled into the nozzle body 714, such as by a small battery-powered pump 722, a manual pump, venturi forces, pressure from the water, etc. The nozzle 710 includes three separate outlets 724 for the chemicals, each of which is positioned between two outlets 726 for water.

Figure 10:
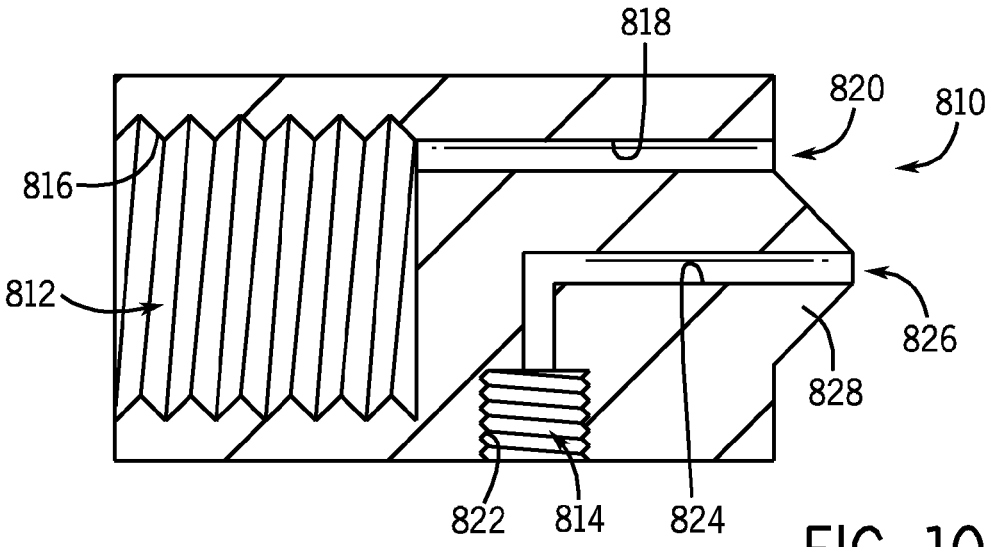
FIG. 10 is a sectional view of a nozzle according to yet another exemplary embodiment of the invention.

Referring now to FIG. 10, a nozzle body 810 includes a first inlet 812 and a second inlet 814, each inlet 812, 814 on a different side of the body 810. The first inlet 812 includes threads 816 for fastening to a wand of a pressure washer, or to a shaft of a spray gun. Two or more substantially parallel passages 818 extend from the first inlet 812 (see also array of conduits 324 as shown in FIG. 3) to an individual outlet 820 for each passage 818. The second inlet 814 includes threads 822 for fastening to a tube delivering chemicals. A passage 824 extends from the second inlet 814 to an chemical outlet 826 on a same side of the nozzle body 810 having the individual outlets 820 from the first inlet 812. The chemical outlet 826 of the nozzle body 810 includes an extension 828 (e.g., projection, cone) upon which the chemical outlet 826 is positioned, intended to facilitate convergence of water streams from the individual outlets 820 and injection of chemicals into the resulting combined water beam.

The construction and arrangements of the nozzle, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A spray gun, comprising:

a handle having a trigger for selectively allowing a pressurized flow of water to pass through at least a portion of the spray gun;

a port for receiving a reservoir of chemicals to be selectively added to the pressurized flow of water;

a nozzle body coupled to the spray gun, the nozzle body comprising:

a first inlet for receiving the pressurized flow of water;

a first outlet formed in an end of the nozzle body;

a second outlet formed in the end of the nozzle body;

a first passage extending between the first inlet and the first outlet;

a second passage extending between the first inlet and the second outlet;

a second inlet for receiving a flow of chemicals from the reservoir of chemicals;

a third outlet formed in the end of the nozzle body; and a third passage extending between the second inlet and the third outlet, wherein the pressurized flow of water from the first inlet is split, passes through the first and second passages, and exits the nozzle body from the first and second outlets during operation of the spray gun; and wherein the second inlet, the third passage, and the third outlet are configured to allow the flow of chemicals to exit the nozzle body contemporaneously with the flow of water from the first and second outlets during operation of the spray gun.

2. The spray gun of claim 1, wherein the first and second passages extend longitudinally through the nozzle body a distance greater than about a quarter of the length of the nozzle body.

3. The spray gun of claim 2, wherein the first and second passages extend longitudinally through the nozzle body a distance about half the length of the nozzle body.

4. The spray gun of claim 1, wherein the first and second passages extend longitudinally through the nozzle body a distance of at least a quarter inch.

5. The spray gun of claim 4, wherein the first and second outlets are arranged symmetrically about an axis of the end of the nozzle body.

6. The spray gun of claim 1, wherein the third outlet is positioned between the first and second outlets.

7. The spray gun of claim 6, wherein the third outlet is positioned in the center of the end of the nozzle body.

8. The spray gun of claim 7, wherein the first and second outlets are substantially equidistant from the third outlet.

9. The spray gun of claim 1, wherein the first and second passages are each substantially straight.

10. The spray gun of claim 9, wherein the first and second passages are substantially parallel.

11. The spray gun of claim 10, wherein the third passage is formed from two substantially straight portions that intersect.

12. The spray gun of claim 11, wherein one of the two portions of the third passage is substantially parallel with the first and second passages.

13. The spray gun of claim 1, wherein the first inlet and the second inlet are on separate sides of the nozzle body.

14. The spray gun of claim 1, further comprising:

a pump coupled to the second inlet for pumping the flow of chemicals from the reservoir to the second inlet.

* * * * *